US006939577B2

(12) United States Patent
Baker et al.

(10) Patent No.: US 6,939,577 B2
(45) Date of Patent: Sep. 6, 2005

(54) METHOD OF MAKING A MATERIAL

(75) Inventors: Julie Baker, Watford (GB); Alan R. Pitt, Harrow (GB)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/682,288

(22) Filed: Oct. 9, 2003

(65) Prior Publication Data

US 2004/0071901 A1 Apr. 15, 2004

(30) Foreign Application Priority Data

Oct. 12, 2002 (GB) ..... 0223835

(51) Int. Cl.[7] ..... B05D 5/00
(52) U.S. Cl. ..... 427/244; 428/32.17
(58) Field of Search ..... 427/244; 428/32.17

(56) References Cited

U.S. PATENT DOCUMENTS 4,089,804 A * 5/1978 Falk ..... 516/9
4,420,434 A * 12/1983 Falk ..... 562/105
2002/0057323 A1 5/2002 Kurachi et al.

FOREIGN PATENT DOCUMENTS

EP 0 474 494 A2 3/1992
EP 0 756 763 A 2/1997
EP 0 816 113 A1 1/1998
EP 0 924 562 A 6/1999
GB 1 591 292 A 6/1981
WO WO 97/06125 * 2/1997

OTHER PUBLICATIONS

Werle et al, Fette. Seifen, Anstrichmittel, 85(5), pp 204–207, 1983.*

Makarewicz et al, Chemik, 56(3), pp 74–82, 2003.*

Raj, Sasthav, and Cheung, "Formation of Polymeric Foams from Aqueous Foams Stabilized Using a Polymerizable Surfactant", 1993, pp. 1453–1470, in Journal of Applied Polymer Science, vol. 49.

* cited by examiner

*Primary Examiner*—Erma Cameron
(74) *Attorney, Agent, or Firm*—Milton S. Sales; Chris P. Konkol

(57) ABSTRACT

The invention provides a method of making a material comprising the steps of: coating a support with a solution comprising a polymer, a blowing agent and a surfactant. Either prior to or after the step of coating the support, the solution is interacted with to cause the blowing agent to generate bubbles within the solution causing foaming of the polymer. The surfactant is selected in dependence on whether or not it satisfies one or more predetermined criteria, to control the size of the bubbles.

14 Claims, 4 Drawing Sheets

METHOD OF MAKING A MATERIAL

CROSS-REFERENCE TO RELATED APPLICATIONS

This is a U.S. Original Patent Application which claims priority on United Kingdom Patent Application No. 0223835.0 filed Oct. 12, 2002.

FIELD OF THE INVENTION

The present invention relates to a method of making a material and in particular to a method of making a foamed material i.e., a material including a foam such as a material suitable for use as an inkjet receiving medium.

BACKGROUND OF THE INVENTION

Traditionally polymer foams are manufactured using mostly hydrophobic thermoplastic materials such as Polyurethane, PVC and Polyethylene, which require high processing temperatures. Prior to forming the foam a gas-filled polymer must be formed. There are a number of typical methods of forming a gas-filled polymer which include thermal decomposition of chemical blowing agents, mechanical whipping of gases into a polymer melt, use of low boiling point liquids, expansion of a gas dissolved in a polymer upon reduction of pressure in the system and the incorporation of microspheres into a polymer mass. Thermal decomposition of chemical blowing agents can be achieved by application of heat or as a result of the exothermic heat of reaction during polymerisation. The decomposition generates a gas such as $N_2$ or $CO_2$, which forms a gas-filled polymer. Incorporation of microspheres into a polymer mass relies on the incorporation of microspheres of a first gas-filled polymer into a polymer mass followed by heating of the mixture to cause expansion of the first gas-filled polymer to form a second gas-filled polymer.

After obtaining the gas-filled polymer by the any of the methods described above, the foam is then formed using one of three common manufacturing processes: compression moulding, reaction injection moulding or extrusion of the foam. The temperatures involved in these processes can be very high, e.g. in excess of 150° C., as the polymers used are in their molten state.

The most common processing method used in creating polymer foam is extrusion. This is a three-stage operation consisting of forming a polymer solution with gas dissolved in it to create a single-phase solution. The gas may be dissolved by injection of $N_2$ or $CO_2$, or by the use of blowing agent. Nucleation sites are then formed, as a result of a rapid pressure drop to create large numbers of uniform sites. Cell growth then takes place by means of diffusion of the gas to form bubbles. Processing conditions provide pressure and temperature changes necessary to control cell growth.

Our co-pending UK Patent Application Number 0218507.2 entitled A METHOD OF MAKING A MATERIAL describes a method of making polymer foams using very low processing temperatures in comparison to conventional methods. In the method a polymer foam can be created in two ways. In a first way voids are produced by generating gas in an aqueous coating solution of a hydrophilic polymer. In a second way an aqueous solution of hydrophilic polymer is coated onto a support, voids being created in the solution after the coating process during the setting and drying of the foam.

To create voids by generating gas in the coating solution, a coating solution is prepared comprising an aqueous solution of a polymer and blowing agent, the solution being treated so that micro-bubbles are formed therein. The coating solution, being a liquid composition containing micro-bubbles, is then coated onto a support. The micro bubbles may be formed in the coating solution by heating the solution to promote the decomposition of the blowing agent to form a gas, or by the addition of an acid to react with the blowing agent to again form a gas within the solution.

To generate voids post coating during the setting and drying process, a solution comprising a polymer and a blowing agent is coated onto a support. The coated support is then heated to a suitable temperature to cause activation of the blowing agent during the setting and drying of the coating.

The size of the bubbles formed in the solution and consequently in the foamed material can affect the physical properties of the foam. For example, the size of the bubbles affects the absorbency of the foamed material. This is important when the material is used as an inkjet-recording medium.

U.S. Patent Publication Number 2002/0057323 in the names of Yasuo Kurachi, Eiichi Ueda, Takayuki Sasaki and Akihisa Nakajima entitled INKJET-RECORDING MATERIAL, relates to a glossy voided inkjet receiver, which combines good drytime and water resistance with minimal cracking. It discloses a 2-layer product where at least 30% of the voids in the material are formed by using a foaming reaction in a layer comprised of organic materials such as synthetic resin monomers and epoxy resins.

The article entitled "Formation of Polymeric Foams From Aqueous Foams Stabilised Using A Polymerisable Surfactant" by Palani Raj W R, Sasthav M, Cheung H M, of Akron University, published in the Journal of Applied Polymer Science; 49, No 8, 20$^{th}$ August 1993, P. 1453–70 describes the creation of stable polymeric foams by purging an aqueous system (made up of a hydrophobic monomer, a polymerisable surfactant and a crosslinking agent) with nitrogen.

PROBLEM TO BE SOLVED BY THE INVENTION

A method of making a material is required that enables the size of the bubbles formed in the material to be controlled. As explained above, the size of the bubbles formed in the solution used in the making of a foamed material and consequently in the foamed material itself can affect the physical properties of the material. For example, the size of the bubbles affects the absorbency of the foamed material.

This is important when the material is used as an inkjet-recording medium. Depending on the application that the inkjet-recording medium is being designed for, differing bubble sizes may be preferred. For example when designing a medium for use with pigmented inks, larger bubbles may be required as pigments tend to block small pores.

The bubble size could also be chosen to ensure that the created material has a required level of gloss, since the smaller the bubbles, the glossier a surface of a material tends to be. Accordingly a method of making a material is required that enables the size of the bubbles formed in the material to be controlled.

SUMMARY OF THE INVENTION

According to a first aspect of the present invention, there is provided a method of making a material comprising the steps of coating a support with a solution comprising a polymer, a blowing agent and a surfactant; and either prior to or after the step of coating said support, interacting with said solution to cause said blowing agent to generate bubbles within the solution, thus causes foaming of the polymer. The surfactant is selected in dependence on whether or not it satisfies one or more predetermined criteria, to control the size of the bubbles.

According to a second aspect of the present invention, there is provided a material, such as an inkjet-recording medium, formed using the method of the first aspect of the present invention.

ADVANTAGEOUS EFFECT OF THE INVENTION

The present invention provides a method by which the size of the voids in the foamed material can be modified through the selection and use of a surfactant in dependence on whether or not the surfactant satisfies one or more predetermined criteria. In particular, it has been found that by choosing an appropriate surfactant, the size of the bubbles in a polymer foam can be adjusted.

In other words, the invention provides a simple and robust method by which control of bubble size may be achieved which is desirable for controlling the average size of bubbles in a polymer foam. As explained above, the average bubble size affects the physical properties of the foam and so depending on the application that the material is being used for, differing bubble sizes may be preferred.

Another aspect of the present invention provides a material made using the method of the present invention. The material may be made having a predetermined bubble size in the foam, such that physical properties of the material that depend on bubble size may be selected.

BRIEF DESCRIPTION OF THE DRAWINGS

Examples of the present invention will now be described with reference to the accompanying drawings, in which.

DETAILED DESCRIPTION OF THE INVENTION

The present invention provides a material and a method of making the material, in which the method includes the step of selecting a surfactant to add to a coating solution used in the manufacture of the material. The coating solution is typically a solution (e.g. an aqueous solution) of a polymer such as a hydrophilic polymer. Examples of hydrophilic polymers include amongst others polyvinyl alcohol, polyethylene oxide, polyvinylpyrrolidone and gelatin. A suitable support such as resin-coated paper, film base, acetate, polyethylene terephthalate PET, printing plate is then coated with the coating solution using a conventional coating method. Any suitable coating method may be used including include amongst others, curtain coating, bead coating or air knife coating. By choosing an appropriate surfactant, it has been found that the size of the bubbles in a polymer foam can be controlled. Accordingly, by selecting an alternative surfactant, the size of the bubbles in the polymer foam can be selectively adjusted.

In a method according to the present invention of manufacturing a foamed material including a polymer foam, the polymer foam is formed by the addition of a blowing agent to an aqueous solution of a hydrophilic polymer, followed by the application of heat to the solution to cause decomposition of the blowing agent and the consequent generation of gas bubbles. Such a method is described in detail in our co-pending UK Patent Application Number 0218507.2 entitled A METHOD OF MAKING A MATERIAL, the entire contents of which are incorporated herein by reference.

According to the present invention selection of a surfactant for addition to the solution enables control of the size of bubbles formed in the material.

Figure 1:
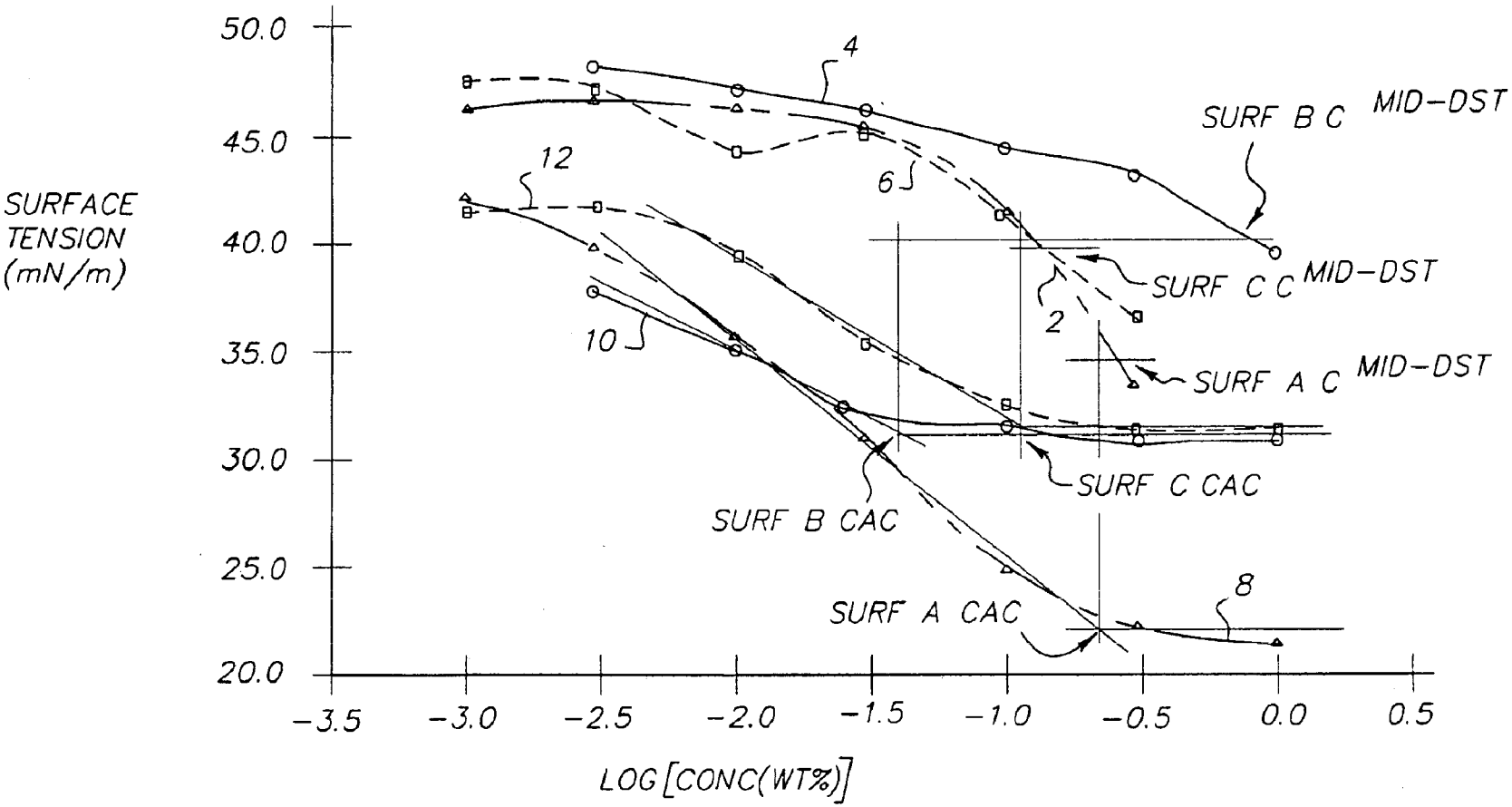
FIG. 1 shows a graph of variation in log (concentration of a surfactant) against surface tension for a number of different surfactants.

FIG. 1 shows a graph of variation in log (concentration of a surfactant) against both dynamic and static surface tension for three different surfactants Surf A, Surf B, and Surf C. Lines 2, 4 and 6 are the relationships between the variation in dynamic surface tension with changing logarithm of the concentration of surfactant for each of surfactants Surf A, Surf B and Surf C respectively. Lines 8, 10 and 12 are the relationships between the variation in static surface tension with changing logarithm of the concentration of surfactant for each of surfactants Surf A, Surf B and Surf C respectively.

For each of the surfactants, two different parameters are determined based on the relationships shown by lines 2 to 12. Firstly, the logarithm corresponding to the critical aggregation concentration CAC of each surfactant is identified as follows. A straight line fit is applied to the region of maximum slope of the static surface tension (SST) curves 8, 10 and 12. Another straight line fit is applied to the region of the SST curve where the surface tension has levelled out at or close to a minimum value. The point at which these two lines intersect represents a logarithm value of a corresponding concentration, the concentration being known as the critical aggregation concentration, or CAC. As explained above, FIG. 1 shows a graph of variation in log (concentration of a surfactant) against both dynamic and static surface tension for three different surfactants. Accordingly, in this example, the CAC is represented by a log value.

Secondly, the log of the concentration corresponding to the midpoint of the dynamic surface tension (DST) curve, log $C^{mid\text{-}DST}$, is interpolated from the point on the DST curve 2, 4 and 6 where the surface tension is midway between that of the solvent i.e. the maximum dynamic surface tension and the value at the CAC i.e. minimum static surface tension.

It can be seen from the Figure that the logarithm of the CAC of surfactant A is almost co-incident with the logarithm of the concentration corresponding to its $C^{mid\text{-}DST}$. Surfactant A also gives a low static surface tension at the concentrations that these surfactants are commonly used at, i.e. log[conc(wt %)]=−0.5. From table 1 below, it can also be seen that this surfactant produces the smallest bubbles.

For surfactant B, it can be seen that the logarithm of its CAC is much lower than the logarithm of the concentration corresponding to its $C^{mid\text{-}DST}$ and that its static surface tension levels out at much higher values than surfactant A. The average bubble size produced by surfactant B is significantly larger than that achieved with surfactant A. Although like surfactant A, the logarithm of the CAC of surfactant C is almost co-incident with the logarithm of the concentration corresponding to its $C^{mid\text{-}DST}$, its static surface tension levels out at a relatively high value like surfactant B, and like surfactant B results in much larger bubbles.

From this data, it is demonstrated that to achieve smaller bubbles the logarithm of the CAC of a surfactant used, needs to be close in value to the logarithm of the concentration corresponding to $C^{mid\text{-}DST}$ for that surfactant and that a low static surface tension of the surfactant is also required. If the graph in FIG. 1 was shown with a linear scale as opposed to a log scale, the condition would be that the CAC must be close in value to $C^{mid\text{-}DST}$. Typically, for a surfactant that satisfies this criterion, the logarithm of its CAC needs to be within 0.5 log units, preferably within 0.25 log units of the logarithm of the concentration corresponding to the $C^{mid\text{-}DST}$. A low static surface tension means a value less than 28 mN/m, preferably less than 24 mN/m. If only one of these criteria is achieved, much larger bubbles are produced.

In other words, for small bubbles to be formed in the foam and material two criteria have to be met: First, the CAC of the surfactant must be of similar concentration to that associated with the midpoint of its dynamic surface tension curve $C^{mid\text{-}DST}$ which may be measured by a specified overflowing cylinder method; and secondly, the surfactant must also have a low static surface tension. If either the difference between the CAC and $C^{mid\text{-}DST}$ is too great i.e. greater than 0.5 log units, or the static surface tension is too high i.e. greater than 28 mN/m, larger bubbles are formed.

EXAMPLES

To demonstrate the invention, materials were prepared as follows:

A resin-coated paper support was coated on one side with three layers. Each layer comprised of polyvinyl alcohol (PVA), blowing agents (a total of 50% by weight compared to the PVA laydown) and some surfactant.

The layer nearest the support consisted of 6.1 g/m$^2$ of PVA, 1.72 g/m$^2$ of sodium nitrite, 1.33 g/m$^2$ of ammonium chloride and 0.106 g/m$^2$ of surfactant. The middle layer consisted of 6.7 g/m$^2$ of PVA, 1.89 g/m$^2$ of sodium nitrite, 1.46 g/m$^2$ of ammonium chloride and 0.212 g/m$^2$ of surfactant. The top layer consisted of 7.3 g/m$^2$ of PVA, 2.06 g/m$^2$ of sodium nitrite, 1.59 g/m$^2$ of ammonium chloride and 0.318 g/m$^2$ of surfactant. The three layers were then coated simultaneously on a bead-coating machine using a standard slide hopper.

To initiate the blowing process, the dryers inside the coating track were set to 90° C. through which the coating of this invention and the control were passed.

Three different surfactants were used to demonstrate the effect that surfactants can have on bubble size. The structures of the three surfactants, A, B and C are shown below:

Surfactant A

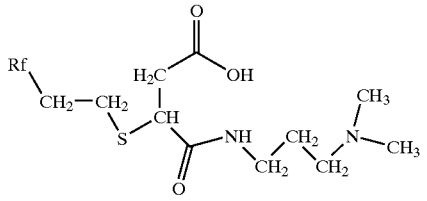

Rf is a range of fluorocarbon chain lengths based on the general structure $C_nF_{2n+1}$, where typically n possesses the following series of values, 6, 8, 10, 12, and 14.

Surfactant B

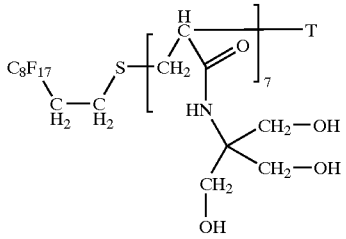

where the terminal group "T" is H.

Sufactant C

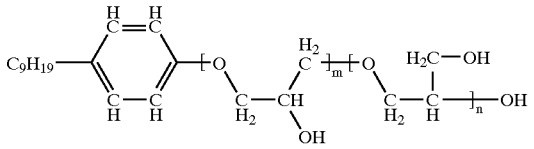

where m+n=10 on average

Figure 2:
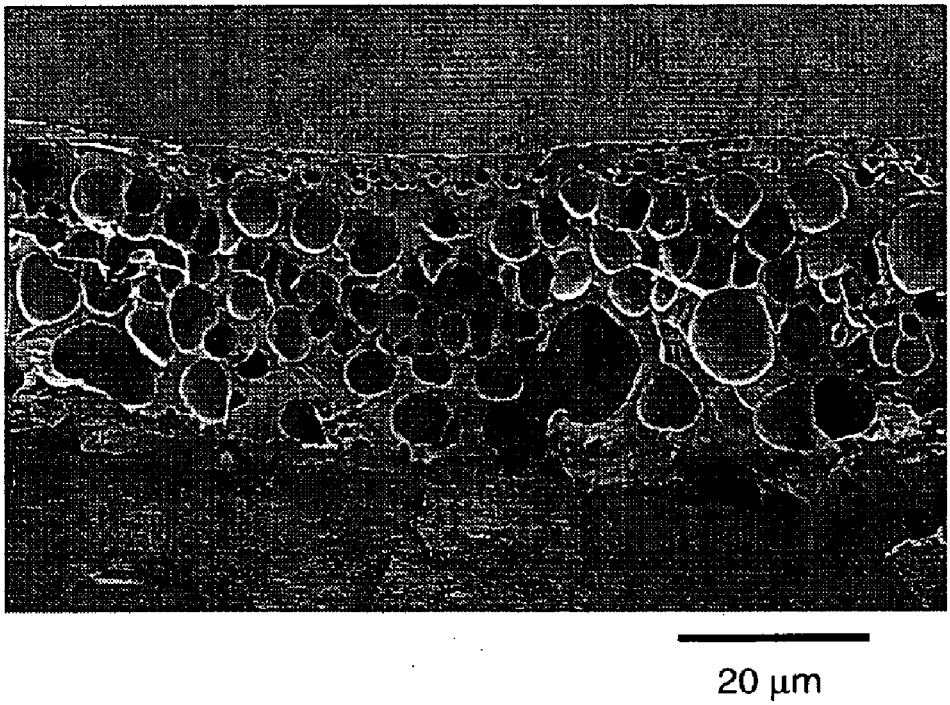
FIGS. 2 to 4 show scanning electron micrographs of sections through materials according to the present invention; and, FIGS. 5 to 7 show schematic representations of sections through three different materials made according to the method of the present invention.
Figure 3:
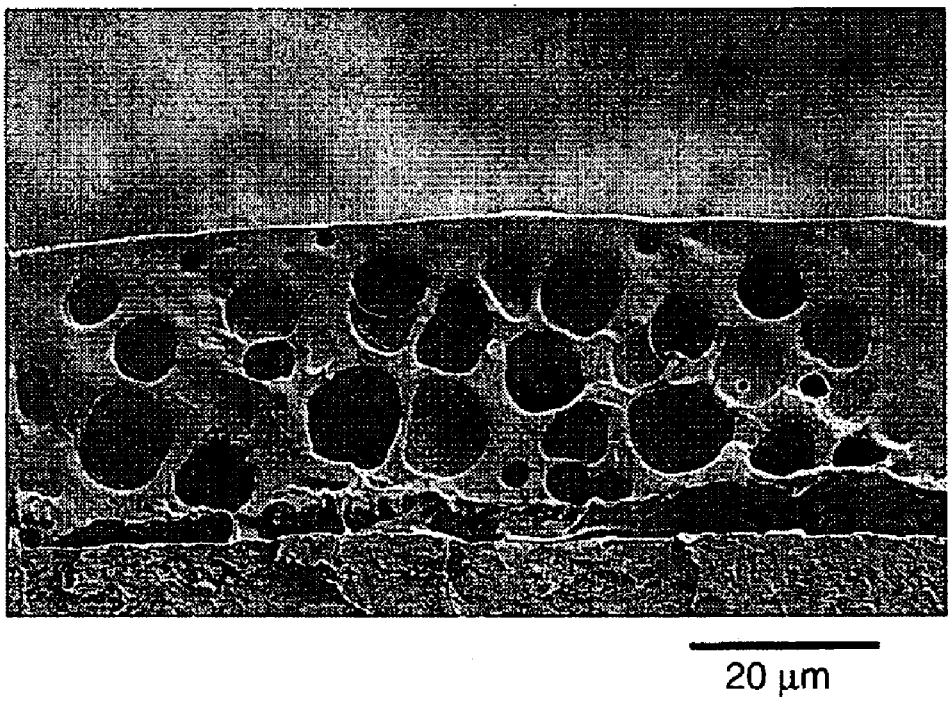
Figure 4:
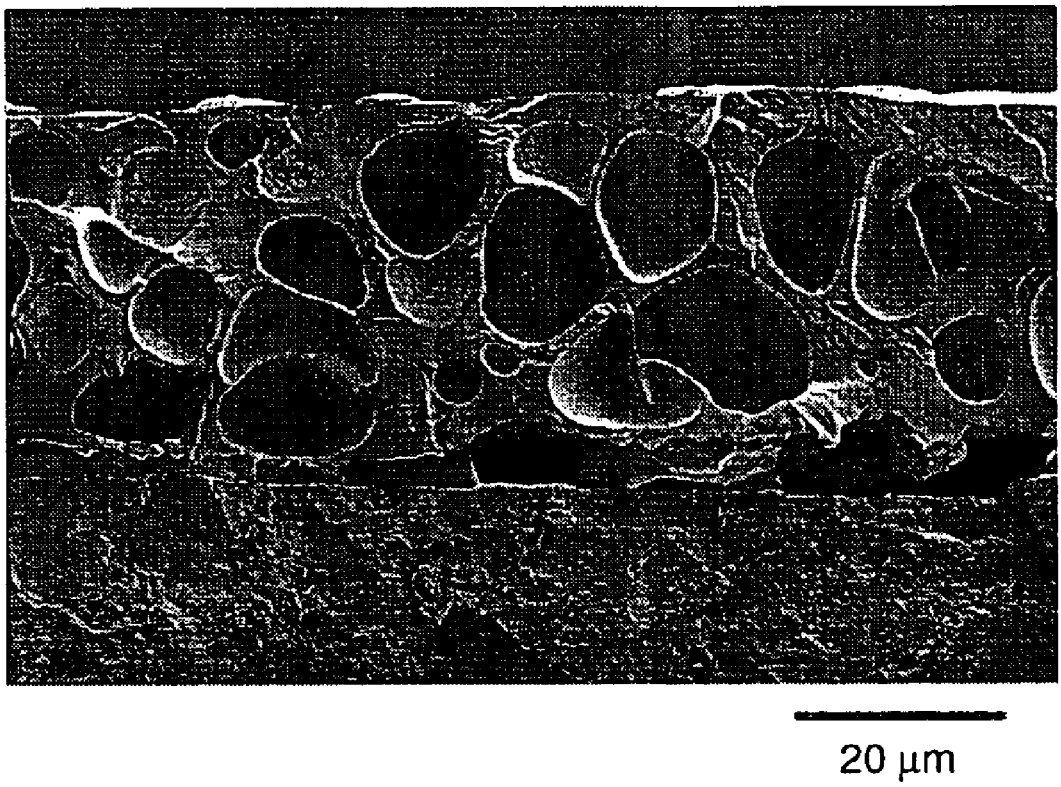
Figure 5:
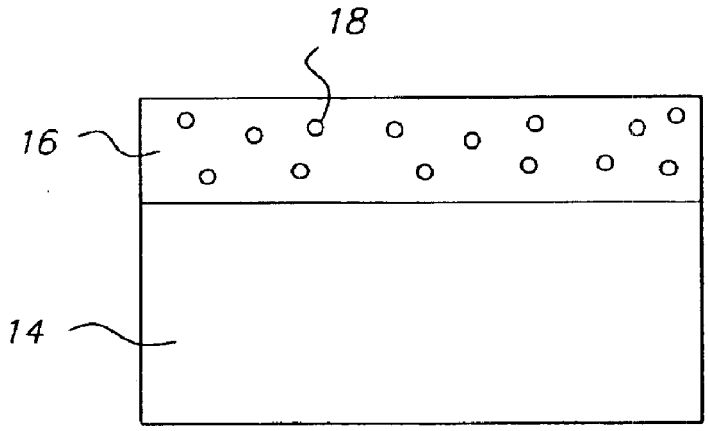
Figure 6:
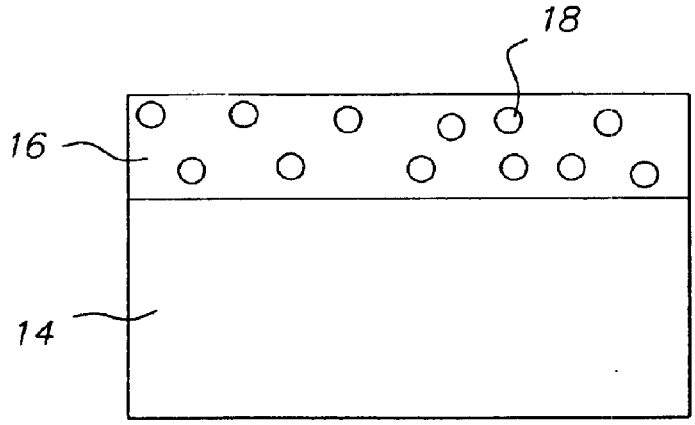
Figure 7:
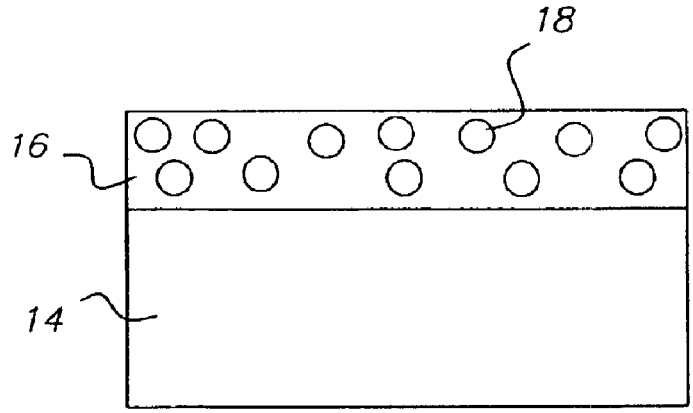

The scanning electron micrographs shown in FIGS. 2 to 4 are sections through the resultant materials formed using surfactants Surf A, Surf B and Surf C respectively. The micrographs indicate that Surf A (FIG. 2) produces bubbles that are considerably smaller than those produced by Surf B (FIG. 3) and Surf C (FIG. 4). The scanning electron micrographs are drawn schematically in FIGS. 5 to 7, corresponding respectively to FIGS. 2 to 4. In each of FIGS. 5 to 7 a support 14 is covered with a layer 16 of foamed polymer. It can be seen that the bubbles 18 are larger in the material formed using Surf B than those in the material formed using Surf A. Similarly, the bubbles in the material formed using Surf C are larger than those in the material formed using Surf A.

Table 1 shows the average bubble size that is achieved when using each of the surfactants.

TABLE 1

| Surfactant | Average Bubble Size (μm) |
|---|---|
| A | 5.35 |
| B | 11.88 |
| C | 14.53 |

The bubble size was measured by placing a randomly chosen area of each coating under the light microscope and a micrograph was then taken using image analysis software (Soft Imaging System, SiS). Prior to taking the micrograph, the software was set to the chosen magnification that had previously been accredited using accredited stage micrometer A818. The diameter of ten randomly chosen bubbles was then measured and the average size calculated.

By measuring the static and dynamic surface tensions of melts containing each surfactant at various concentrations and plotting the results as a function of log (concentration), the logarithms of the critical aggregation concentration and the midpoint of the dynamic surface tension curve can be identified.

Any suitable method may be used to measure dynamic and static surface tension of liquids. In the present examples, the surface tensions of a range of concentrations of the test surfactant are measured in the trial coating composition under a standard set of conditions at 40° C. The concentration of the surfactant was usually varied from 0.001 to 1 wt % in log concentration intervals of ~0.5. Higher or intermediate concentrations were sometimes measured as necessary to improve estimates of critical aggregation concentration or the midpoint of the dynamic surface tension curve.

Both the static surface tension SST and dynamic surface tension DST measurements were made using the Wilhelmy blade method as described by Padday, J F, $2^{nd}$ Int. Congress of Surface Activity, Butterworths, 1957, 1, 1. The DST measurements were made with an overflowing circular cylinder, having a diameter of 37.5 mm and a liquid overflow rate of ~9 ml/sec. The data were obtained by raising the surface of the flowing liquid until it just touched the Wilhelmy blade, momentarily dipping the blade by electromechanical means to induce wetting, and taking a final reading 60 seconds later. Other suitable methods of measuring dynamic surface tension would be any technique that offers similar dynamic time scales (surface age) i.e. of the order of 0.05 to 0.25 seconds. Examples include the maximum bubble pressure method and the falling curtain method.

The SST measurements were not true equilibrium values, but values taken after a defined period. SST values were obtained by, stopping the flow in the dynamic cell, waiting 30 seconds, raising the surface of the liquid until it just touches the Wilhelmy blade, momentarily dipping the blade by electromechanical means to induce wetting, and taking a final reading 60 seconds later, i.e. 90 seconds after stopping the flow.

What is claimed is:

1. A method of making a material comprising the steps of:

coating a support with a solution comprising a polymer, a blowing agent and a surfactant; and, either prior to or after the step of coating said support, interacting with said solution to cause said blowing agent to generate bubbles within the solution causing foaming of the polymer, the surfactant being selected to control the size of the bubbles.

2. A method according to claim 1, in which the surfactant is

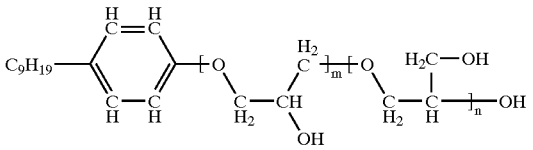

wherein m+n=10 on average.

3. A method according to claim 1, in which the surfactant is

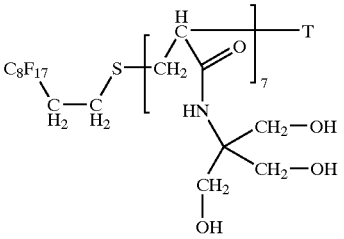

where the terminal group "T" is H.

4. A method according to claim 1, in which the surfactant is

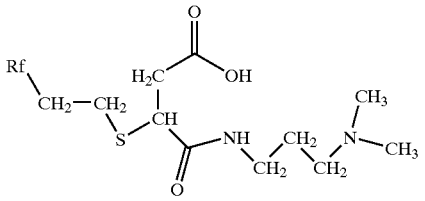

where Rf is a range of fluorocarbon chain lengths based on the general structure $C_nF_{2n+1}$, where n possesses a value selected from one or more of the group consisting of 6, 8, 10, 12, and 14.

5. A method according to claim 1, in which the proportion by weight of surfactant to coating solution is from about 0.01% to about 2.0%.

6. A method according to claim 1, in which the surfactant used is a fluoro-surfactant.

7. A method according to claim 1, in which the proportion by weight of surfactant to coating solution is from about 0.01% to about 1.0%.

8. A method according to claim 1, in which the polymer is a hydrophilic polymer.

9. A method according to claim 8, in which the hydrophilic polymer is selected from the group consisting of polyvinyl alcohol, polyethylene oxide, polyvinylpyrrolidone and gelatin.

10. A method according to claim 1, wherein the surfactant is selected in dependence upon it satisfying one or more criteria, one or more criteria include the critical aggregation concentration of the surfactant being substantially the same as the concentration associated with the midpoint of the dynamic surface tension curve of the surfactant; and, the surfactant having a static surface tension less than about 28 mN/m.

11. A method according to claim 10, in which when both criteria are satisfied, the average bubble size is less than if one or both of the criteria are not satisfied.

12. A method according to claim 10, in which one of the criteria is the surfactant having a static surface tension less than about 24 mN/m.

13. A method according to claim 10, in which one of the criteria is the logarithm of the critical aggregation concentration of the surfactant being within about 0.5 log units of the concentration associated with the midpoint of the dynamic surface tension curve of the surfactant.

14. A method according to claim 10, in which one of the criteria is the logarithm of the critical aggregation concentration of the surfactant being within about 0.25 log units of the concentration associated with the midpoint of the dynamic surface tension curve of the surfactant.

* * * * *